US011614706B2

(12) United States Patent
Onishi

(10) Patent No.: US 11,614,706 B2
(45) Date of Patent: Mar. 28, 2023

(54) IMAGE FORMING APPARATUS

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/662,913

(22) Filed: May 11, 2022

(65) Prior Publication Data

US 2022/0373960 A1 Nov. 24, 2022

(30) Foreign Application Priority Data

May 24, 2021 (JP) ..... JP2021-086894

(51) Int. Cl.
*G03G 15/00* (2006.01)
*G03G 21/16* (2006.01)

(52) U.S. Cl.
CPC ..... *G03G 21/1633* (2013.01); *G03G 21/1685* (2013.01)

(58) Field of Classification Search
CPC ..... G03G 15/2017; G03G 15/6573; G03G 21/1633; G03G 21/1638; G03G 21/1685
See application file for complete search history.

(56) References Cited

U.S. PATENT DOCUMENTS 7,176,952 B2 * 2/2007 Ishida ..... G03G 15/2028 347/156
7,917,062 B2 * 3/2011 Shin ..... G03G 15/657 399/124
8,340,535 B2 * 12/2012 Uehara ..... G03G 21/1638 399/124
2011/0044704 A1 2/2011 Uehara

FOREIGN PATENT DOCUMENTS

JP 2011043578 A 3/2011

* cited by examiner

*Primary Examiner* — Hoang X Ngo
(74) *Attorney, Agent, or Firm* — Alleman Hall Creasman & Tuttle LLP

(57) ABSTRACT

An image forming apparatus is provided with a printing device, a sheet conveyance path, a protective cover, a swing member, and a biasing member. The sheet conveyance path includes an upper guide portion and a lower guide portion. The swing member is supported inside a main body and can swing upward from a standard position. The biasing member biases the swing member to the standard position. The swing member includes the upper guide portion. The protective cover includes the lower guide portion and a contact portion. The contact portion pushes the swing member upward when the protective cover pivots in an outward position from a closed position. The protective cover can pivot from the closed position to an open position as the contact portion pushes the swing member upward.

7 Claims, 4 Drawing Sheets

IMAGE FORMING APPARATUS

INCORPORATION BY REFERENCE

This application is based upon and claims the benefit of priority from the corresponding Japanese Patent Application No. 2021-086894 filed on May 24, 2021, the entire contents of which are incorporated herein by reference.

BACKGROUND

The present disclosure relates to an image forming apparatus provided with a cover including a guide portion for guiding a sheet.

An image forming apparatus is provided with a sheet guide portion that forms a sheet conveyance path. The sheet guide portion includes a pair of guide portions disposed to face each other.

In addition, one of the pair of guide portions may be provided for a cover that can open and close a part of the main body. The pair of guide portions are separated from each other by opening the cover. This facilitates removal of paper jams in the sheet conveyance path.

In addition, an electrophotographic image forming apparatus may be provided with a main conveyance path extending via a transfer position and a fixing position and a sub conveyance path through which sheets conveyed reversely by a pair of discharge rollers pass.

The sub conveyance path branches off from the main conveyance path at a point adjacent to a discharge opening and merges with the main conveyance path at a point upstream of the transfer position. In a case of duplex printing, the sheets are conveyed along the main conveyance path, pass through the sub conveyance path, and are then conveyed along the main conveyance path again.

In the image forming apparatus described above, a protective cover that covers a fixing device may include one of the pair of guide portions. The protective cover includes a lower guide portion located below an introduction part of the sub conveyance path. In addition, an upper guide portion located above the introduction part of the sub conveyance path is provided for the main body. The upper guide portion and the lower guide portion guide the sheets in a lateral direction.

SUMMARY

An image forming apparatus according to an aspect of the present disclosure is provided with a printing device, a sheet conveyance path, a protective cover, a swing member, and a biasing member. The printing device is provided inside a main body and forms an image on a sheet. The sheet conveyance path includes an upper guide portion located above a specific position inside the main body and a lower guide portion located below the upper guide portion. The protective cover is supported in the main body to be pivotable on a first support shaft in an outward direction from a closed position in which the protective cover covers a protected unit constituting a part of the printing device. The swing member is supported in the main body to be swingable on a second support shaft upward from a standard position. The biasing member biases the swing member to the standard position. The swing member includes the upper guide portion. The protective cover includes the lower guide portion and a contact portion. The contact portion pushes the swing member upward from the standard position when the protective cover pivots in the outward direction from the closed position. The protective cover can pivot from the closed position to an open position, in which the protective cover is away from the protected unit to open an inside of the image forming apparatus, as the contact portion pushes the swing member upward. The protective cover forms a part of the sheet conveyance path when in the closed position and opens the sheet conveyance path when in the open position.

An image forming apparatus according to another aspect of the present disclosure is provided with a main body, a fixing portion, a sheet conveying portion, a protective cover, and a swing member. The fixing portion is provided inside the main body and fixes a toner image formed on a sheet to the sheet. The sheet conveying portion conveys the sheet from the fixing portion to a discharge opening along a main conveyance path and can convey the sheet reversely at the discharge opening to a reverse conveyance path branching off from the main conveyance path. The protective cover is supported so as to be pivotable between a closed position in which the protective cover covers the fixing unit and an open position in which the protective cover is away from the fixing unit to open an inside of the image forming apparatus, the protective cover forming a part of a lower surface of the reverse conveyance path. The swing member is swingably supported above the protective cover in the main body and forms a part of an upper surface of the reverse conveyance path. The protective cover includes a contact portion moved upward to abut on the swing member when the protective cover pivots from the closed position to the open position. The swing member swings upward and retracts by being brought into contact with the contact portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment is provided with a printing device 4 that performs a printing process of forming images on sheets 9.

The printing device 4 performs the printing process by an electrophotographic method. The sheets 9 are sheets of paper or image formation media such as sheet-like resin members.

Figure 1:
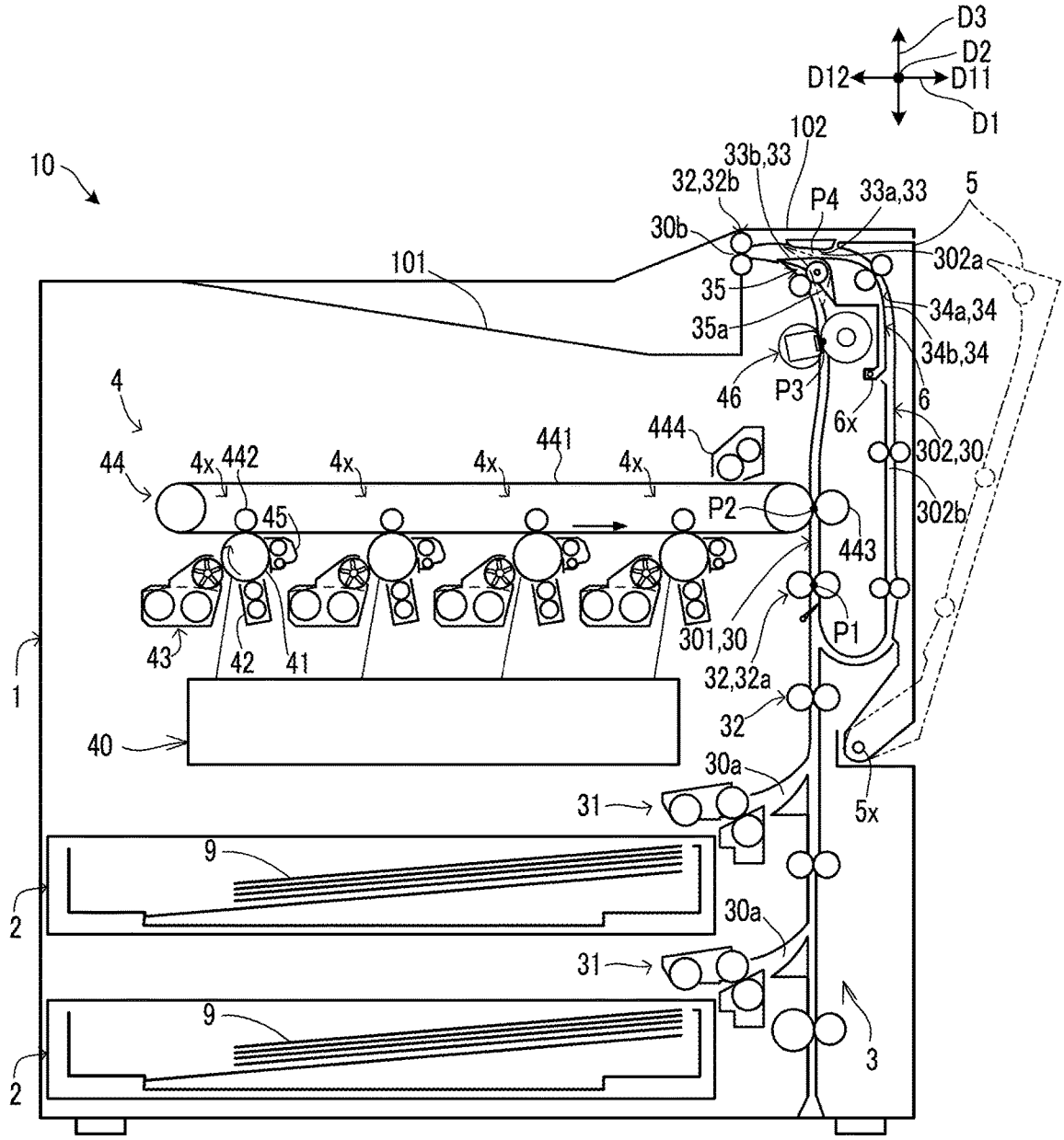
FIG. 1 is a configuration diagram of an image forming apparatus according to an embodiment.

As shown in FIG. 1, the image forming apparatus 10 is provided with a sheet conveying device 3 and the printing device 4 disposed inside a main body 1. The main body 1 is a housing that houses the sheet conveying device 3, the printing device 4, and other components.

The printing device 4 includes one or more image creating devices 4*x*, a laser scanning unit 40, a transfer device 44, and a fixing device 46. Each of the image creating devices 4*x* includes a drum-like photoconductor 41, a charging device 42, a developing device 43, and a drum cleaning device 45.

The sheet conveying device 3 is provided with sheet feed devices 31 and multiple pairs of conveying rollers 32. The sheet conveying device 3 is further provided with a drive device (not shown) that drives the sheet feed devices 31 and the multiple pairs of conveying rollers 32.

The sheet feed devices 31 send the sheets 9 housed in sheet storing portions 2 to a sheet conveyance path 30 inside the main body 1. The sheet conveyance path 30 constitutes a passage through which the sheets 9 are conveyed.

The pairs of conveying rollers 32 are rotationally driven by the drive device. The pairs of conveying rollers 32 rotate while holding the sheets 9 in between to convey the sheets 9 along the sheet conveyance path 30.

The sheet conveyance path 30 includes a main conveyance path 301 and a sub conveyance path 302. The main conveyance path 301 is a route extending from feed openings 30*a* to a discharge opening 30*b* via a registration position P1, a transfer position P2, and a fixing position P3.

In the present embodiment, the transfer position P2 is located above the registration position P1, and the fixing position P3 is located above the transfer position P2. In addition, the registration position P1 is located above the feed openings 30*a*, and the discharge opening 30*b* is located above the fixing position P3.

The sub conveyance path 302 branches off from the main conveyance path 301 at a point between the fixing position P3 and the discharge opening 30*b* and merges with the main conveyance path 301 at a point upstream of the registration position P1.

The pairs of conveying rollers 32 include a pair of registration rollers 32*a* and a pair of discharge rollers 32*b*. The pairs of conveying rollers 32 convey the sheets 9 to the discharge opening 30*b* via the registration position P1, the transfer position P2, and the fixing position P3. The pairs of conveying rollers 32 are an example of a sheet conveying portion.

The pair of registration rollers 32*a* temporarily stops the sheets 9 at the registration position P1 and then sends the sheets 9 to the transfer position P2. The timing at which the sheets 9 are fed to the transfer position P2 is adjusted by the action of the pair of registration rollers 32*a*.

The pair of discharge rollers 32*b* rotates in a first rotation direction to discharge the sheets 9, having passed through the fixing position P3, from the discharge opening 30*b* in the main conveyance path 301 onto a discharge tray 101.

The sheet conveying device 3 is further provided with a route switching mechanism 35. The route switching mechanism 35 is provided with a movable member 35*a* and an actuator such as a solenoid (not shown). The movable member 35*a* selectively switches to either a first state or a second state by the operation of the actuator.

The initial state of the movable member 35*a* is the first state. In FIG. 1, the movable member 35*a* in the first state is indicated by solid lines, whereas the movable member 35*a* in the second state is indicated by long dashed double-short dashed lines.

The movable member 35*a* in the second state opens a route extending from the fixing position P3 to the discharge opening 30*b* in the main conveyance path 301. In contrast, the movable member 35*a* in the first state opens a route extending from the discharge opening 30*b* in the main conveyance path 301 to the sub conveyance path 302.

When the movable member 35*a* is in the first state, the pair of discharge rollers 32*b* is rotationally driven in a second rotation direction. The second rotation direction is a direction opposite the first rotation direction. The pair of discharge rollers 32*b* rotates in the second rotation direction to convey the sheets 9 reversely. This feeds the sheets 9 into an inward-outward conveyance path 302*a* in the sub conveyance path 302. That is, the pair of discharge rollers 32*b* can convey the sheets 9 reversely to the inward-outward conveyance path 302*a* at the discharge opening 30*b*.

Some of the pairs of conveying rollers 32 convey the sheets 9 along the sub conveyance path 302 and then sends the sheets 9 again to the registration position P1 in the main conveyance path 301.

The printing device 4 forms toner images on the sheets 9 conveyed along the main conveyance path 301 by the sheet conveying device 3. The toner images are developer images having toner as developer. The toner is an example of particulate developer.

The image forming apparatus 10 shown in FIG. 1 is a color image forming apparatus of a tandem type. Accordingly, the printing device 4 is provided with multiple image creating devices 4*x* corresponding to the toner of multiple colors. In the present embodiment, the printing device 4 is provided with four image creating devices 4*x* corresponding to four colors of yellow, cyan, magenta, and black.

In each of the image creating devices 4*x*, the photoconductor 41 rotates, and the charging device 42 electrically charges the surface of the photoconductor 41. Subsequently, the laser scanning unit 40 scans laser beams to form electrostatic latent images on the surfaces of the photoconductors 41.

Furthermore, the developing devices 43 supply the toner to the surfaces of the respective photoconductors 41 to develop the electrostatic latent images as the toner images. The photoconductors 41 are an example of an image-carrying member that rotates while carrying the toner image.

The transfer device 44 transfers the toner images to the sheets 9 at the transfer position P2 in the sheet conveyance path 30. The transfer device 44 is an example of a transfer portion. The transfer device 44 is provided with an intermediate transfer belt 441, four primary transfer devices 442 corresponding to the four image creating devices 4*x*, a secondary transfer device 443, and a belt cleaning device 444.

In the transfer device 44, the primary transfer devices 442 transfer the toner images from the surfaces of the respective photoconductors 41 to the surface of the intermediate transfer belt 441. This forms the toner images of color on the surface of the intermediate transfer belt 441.

The secondary transfer device 443 transfers the toner images formed on the intermediate transfer belt 441 to the sheets 9 at the transfer position P2 in the main conveyance path 301.

In a case where the image forming apparatus 10 is a monochrome image forming apparatus, the secondary transfer device 443 transfers the toner images on a photoconductor 41 to the sheets 9 at the transfer position P2.

The drum cleaning devices 45 remove remaining waste toner from the surfaces of the respective photoconductors 41. The belt cleaning device 444 removes remaining waste toner from the intermediate transfer belt 441.

The fixing device 46 pressurizes and heats the toner images on the sheets 9 at the fixing position P3 in the main conveyance path 301 while conveying the sheets 9. Thus, the fixing device 46 fixes the toner images to the sheets 9. The fixing device 46 is an example of a fixing portion.

The image forming apparatus 10 is further provided with an outer cover 5 that closes an opening formed in the main body 1 and a protective cover 6 disposed inside the outer cover 5. In the description below, a direction away from the outer cover 5 or the protective cover 6 to the exterior of the main body 1 is referred to as "outward direction D11". In contrast, a direction opposite the outward direction D11 is referred to as "inward direction D12". Furthermore, a direction parallel to the outward direction D11 and the inward direction D12 is referred to as "inward-outward direction D1".

In the drawings, a width direction D2 is a horizontal direction intersecting with the inward-outward direction D1. In addition, a longitudinal direction D3 is a direction intersecting with the inward-outward direction D1 and the width direction D2. The longitudinal direction D3 corresponds to the up-down direction.

Figure 4:
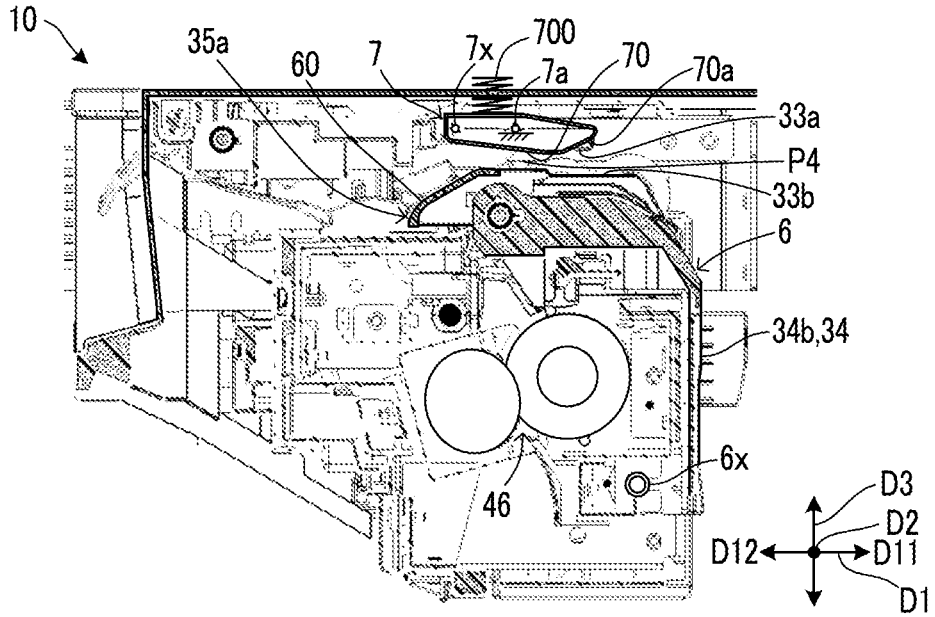
FIG. 4 is a first cross-sectional view of a periphery of a fixing device in the image forming apparatus according to the embodiment (the protective cover is in a closed state).

An output part of the main conveyance path 301 and an introduction part of the sub conveyance path 302 are formed in the inward-outward direction D1. A specific position P4 shown in FIGS. 1 and 4 is located in the introduction part of the sub conveyance path 302.

The sheet conveying device 3 is provided with a horizontal guide portion 33 that forms inward-outward conveyance path 302*a* at the specific position P4 inside the main body 1. The horizontal guide portion 33 includes an upper guide portion 33*a* located above the specific position P4 and a lower guide portion 33*b* located below the specific position P4. In other words, the inward-outward conveyance path 302*a* includes the upper guide portion 33*a* and the lower guide portion 33*b*. The upper guide portion 33*a* is disposed along the lower surface of a top portion 102 of the main body 1.

The inward-outward conveyance path 302*a* formed by the upper guide portion 33*a* and the lower guide portion 33*b* is a part of the sub conveyance path 302. When the pair of discharge rollers 32*b* rotates in the second rotation direction, the sheets 9 conveyed reversely by the pair of discharge rollers 32*b* pass through the inward-outward conveyance path 302*a*. The lower guide portion 33*b* forms a part of the lower surface of the inward-outward conveyance path 302*a*. The inward-outward conveyance path 302*a* is an example of a reverse conveyance path.

The inward-outward conveyance path 302*a* is the introduction part of the sub conveyance path 302. The sub conveyance path 302 includes the inward-outward conveyance path 302*a* and a longitudinal conveyance path 302*b* adjoining the inward-outward conveyance path 302*a*. The longitudinal conveyance path 302*b* is formed in the longitudinal direction D3.

The outer cover 5 is pivotably supported by the main body 1. The outer cover 5 is pivotable on a support shaft 5*x* supported by the main body 1. The outer cover 5 is pivotable in the outward direction D11 from a closed position in which the outer cover 5 covers the protective cover 6. The support shaft 5*x* serves as a pivot of the outer cover 5.

The protective cover 6 covers a side of the fixing device 46 facing the outward direction D11. The fixing device 46 is an example of a protected unit constituting a part of the printing device 4.

The protective cover 6 is supported to be pivotable on a support shaft 6*x* supported by the main body 1. The protective cover 6 is pivotable in the outward direction D11 from a closed position in which the protective cover 6 covers the fixing device 46. The support shaft 6*x* is located at a position away from the specific position P4 obliquely downward and in the outward direction D11. The support shaft 6*x* serves as a pivot of the protective cover 6. The support shaft 6*x* is an example of a first support shaft.

In a case where the lower guide portion 33*b* is provided for the protective cover 6, the lower guide portion 33*b* moves along an arc centered on the support shaft 6*x* when the protective cover 6 is opened. At that moment, the lower guide portion 33*b* moves upward along the arc from a position for guiding the sheets 9.

However, if the lower guide portion 33*b* is caught by the upper guide portion 33*a* during the opening of the protective cover 6, the protective cover 6 cannot be opened to a position where the inside of the image forming apparatus 10 is opened.

In a case where the upper guide portion 33*a* is disposed above the lower guide portion 33*b* to be sufficiently away from the lower guide portion 33*b*, the lower guide portion 33*b* is prevented from being caught by the upper guide portion 33*a*. In this case, however, the image forming apparatus 10 increases in height. Furthermore, an increase in the space between the lower guide portion 33*b* and the upper guide portion 33*a* may adversely affect the performance in guiding the sheets 9.

As described below, in the image forming apparatus 10, the protective cover 6 includes the lower guide portion 33*b*. Furthermore, the image forming apparatus 10 is provided with a retraction mechanism for retracting the upper guide portion 33*a* as the lower guide portion 33*b* moves.

The action of the retraction mechanism can prevent the lower guide portion 33*b* from being caught by the upper guide portion 33*a* during the opening of the protective cover 6 without increasing the space between the lower guide portion 33*b* and the upper guide portion 33*a*.

[Retraction Mechanism]

The retraction mechanism is provided with a swing member 7 and springs 700 (see FIGS. 3 to 6).

Figure 6:
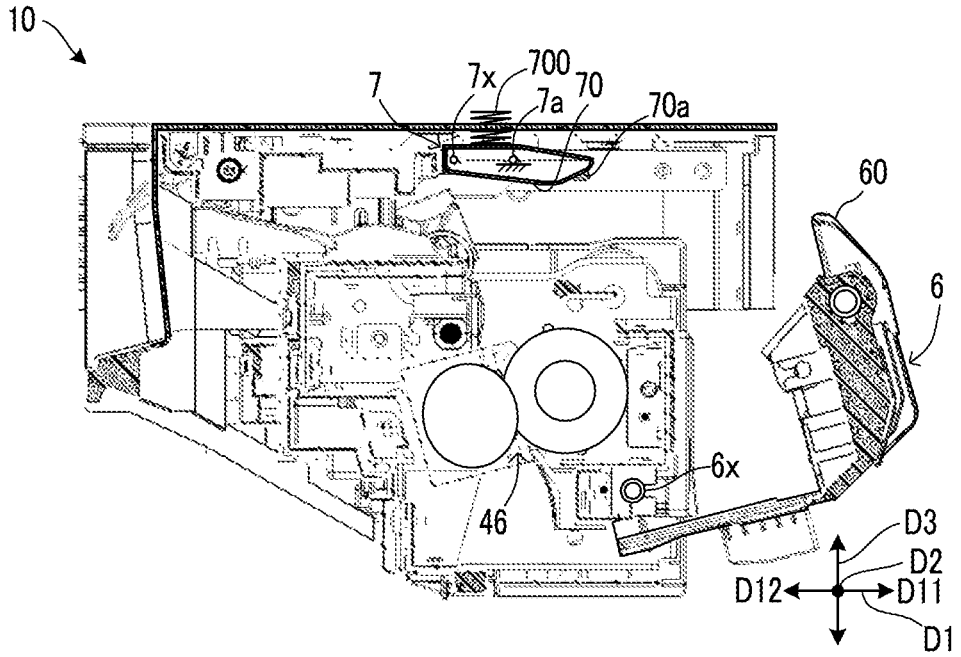
FIG. 6 is a third cross-sectional view of the periphery of the fixing device in the image forming apparatus according to the embodiment (the protective cover is in an open state).

The swing member 7 is supported by the main body 1. The swing member 7 is supported to be swingable upward from a predetermined standard position. FIGS. 4 and 6 show the swing member 7 in the standard position.

The swing member 7 includes a shaft portion 7*x* in a part adjacent to an end of the swing member 7 facing the inward direction D12. The shaft portion 7*x* is rotatably supported by the main body 1. The swing member 7 is swingable on the shaft portion 7*x*. The shaft portion 7*x* is an example of a second support shaft.

Figure 2:
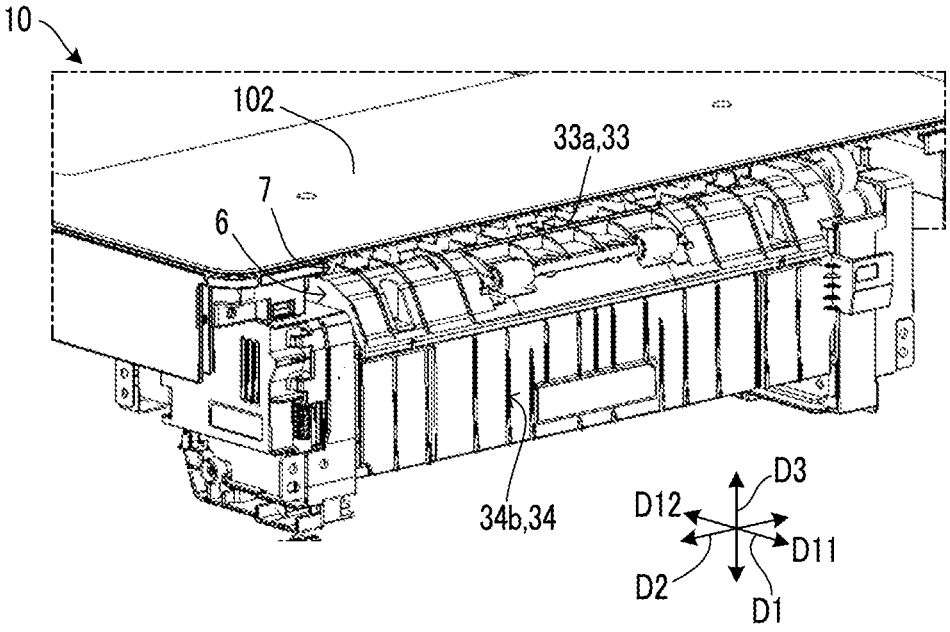
FIG. 2 is a perspective view of and around a protective cover in the image forming apparatus according to the embodiment.
Figure 3:
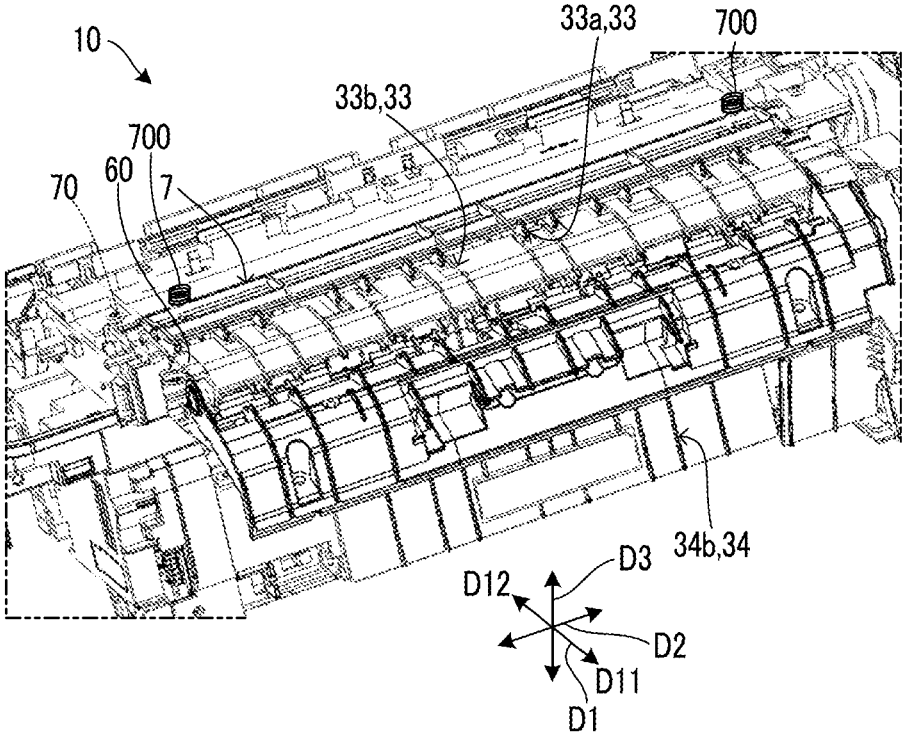
FIG. 3 is a perspective view of and around a swing member in the image forming apparatus according to the embodiment.

The swing member 7 includes the upper guide portion 33*a* on the lower surface thereof (see FIGS. 2 to 4). The swing member 7 further includes a protruding portion 7*a* caught by part of the main body 1 (see FIG. 4). The upper guide portion 33*a* of the swing member 7 forms a part of the upper surface of the inward-outward conveyance path 302*a*.

The springs 700 elastically bias the swing member 7 to the standard position. The springs 700 are an example of a biasing member. Other biasing members such as rubber or flexible synthetic resin members may be used instead of the springs 700.

The part of the main body 1 catches the protruding portion 7*a* against the biasing force of the springs 700. This keeps the swing member 7 in the standard position.

As shown in FIGS. 3 and 4, the protective cover 6 includes the lower guide portion 33*b*. In the present embodiment, the protective cover 6 includes the movable member 35*a* of the route switching mechanism 35 (see FIG. 4). The movable member 35*a* includes the lower guide portion 33*b* on the upper surface thereof. When the protective cover 6 is opened and closed, the movable member 35*a* is in the first state.

The protective cover 6 forms the inward-outward conveyance path 302*a* when in the closed position and opens the inward-outward conveyance path 302*a* when in an open position. The inward-outward conveyance path 302*a* is a part of the sub conveyance path 302.

The protective cover 6 further includes an inner vertical guide portion 34*b* adjoining the lower guide portion 33*b* (see FIGS. 1, 3 and 4). The inner vertical guide portion 34*b* and the lower guide portion 33*b* face first sides of the sheets 9 conveyed reversely by the pair of discharge rollers 32*b*.

The outer cover 5 includes an outer vertical guide portion 34*a* on the inner surface thereof (see FIG. 1). The outer vertical guide portion 34*a* faces the inner vertical guide portion 34*b*. The outer vertical guide portion 34*a* and the upper guide portion 33*a* face second sides of the sheets 9 conveyed reversely by the pair of discharge rollers 32*b*.

The outer vertical guide portion 34*a* and the inner vertical guide portion 34*b* guide the sheets 9 downward. The outer vertical guide portion 34*a* and the inner vertical guide portion 34*b* form the longitudinal conveyance path 302*b* in the sub conveyance path 302. The longitudinal conveyance path 302*b* is a part of the sub conveyance path 302.

Figure 5:
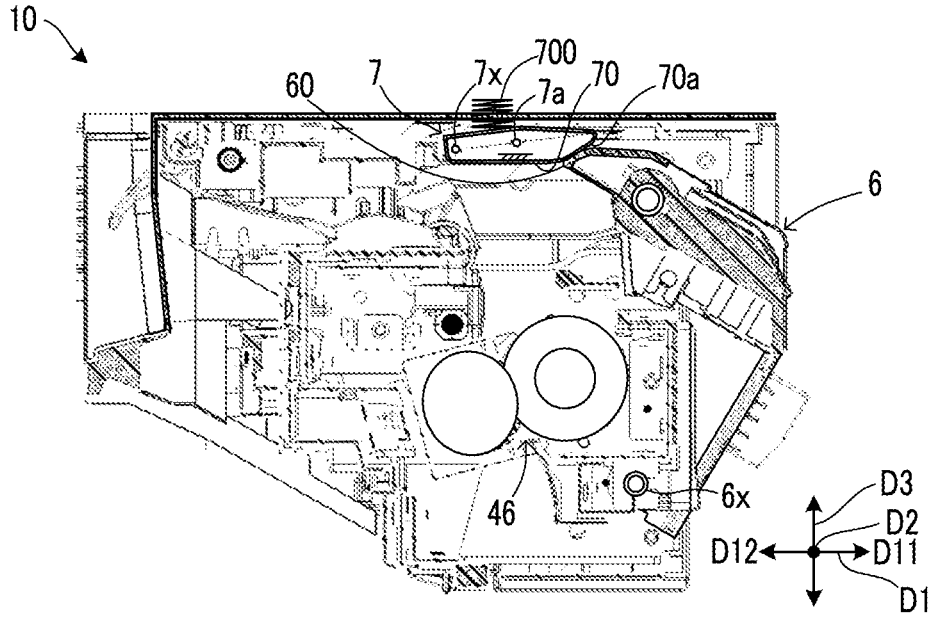
FIG. 5 is a second cross-sectional view of the periphery of the fixing device in the image forming apparatus according to the embodiment (the protective cover is being opened).

The protective cover 6 includes a contact portion 60 that comes into contact with part of the swing member 7 when the protective cover 6 pivots in the outward direction D11 from the closed position (see FIGS. 3 to 5). For example, the movable member 35*a* includes the contact portion 60. When the protective cover 6 pivots from the closed position to the open position, the lower guide portion 33*b* on the movable member 35*a* may abut on the swing member 7 while moving upward. It is noted that part of the protective cover 6 other than the movable member 35*a* may serve as the contact portion 60.

When the protective cover 6 pivots in the outward direction D11 from the closed position, the contact portion 60 moves upward to abut on the swing member 7. At that moment, the contact portion 60 pushes the swing member 7 upward from the standard position (see FIG. 5).

The swing member 7 includes a sliding surface 70 on which the contact portion 60 slides when the protective cover 6 pivots in the outward direction D11 from the closed position (see FIGS. 4 and 5). The protective cover 6 pivots in the outward direction D11 from the closed position by user operations.

The protective cover 6 can pivot from the closed position to the open position (see FIGS. 5 and 6) as the contact portion 60 pushes the swing member 7 upward. That is, the swing member 7 swings upward and retracts by being brought into contact with the contact portion 60. The protective cover 6 pivots to the open position to be away from the fixing device 46 to make the fixing device 46 exposed in the outward direction D11.

As shown in FIG. 3, the contact portion 60 is formed on the outer side, along the width direction D2, of the lower guide portion 33*b* on the protective cover 6. In the protective cover 6, the width direction D2 is a direction intersecting with a conveying direction of the sheets 9.

Similarly, the sliding surface 70 is formed on the outer side, along the width direction D2, of the upper guide portion 33*a*. The contact portion 60 and the sliding surface 70 face each other in the longitudinal direction D3.

When the protective cover 6 pivots in the outward direction D11, the protective cover 6 can pivot from the closed position to the open position without the lower guide portion 33*b* coming into contact with the upper guide portion 33*a*.

In addition, the sliding surface 70 includes an inclined surface 70*a* (see FIGS. 4 and 6) inclined obliquely upward and in the outward direction D11. Accordingly, when the protective cover 6 pivots in the inward direction D12 from the open position, the contact portion 60 smoothly slides on the inclined surface 70*a* to push the swing member 7 upward.

The adoption of the retraction mechanism prevents the lower guide portion 33*b* from being caught by the upper guide portion 33*a* during the opening of the protective cover 6 without increasing the space between the lower guide portion 33*b* and the upper guide portion 33*a*.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a printing device provided inside a main body and configured to form an image on a sheet;

a sheet conveyance path including an upper guide portion located above a specific position inside the main body and a lower guide portion located below the upper guide portion;

a protective cover supported in the main body to be pivotable on a first support shaft in an outward direction from a closed position in which the protective cover covers a protected unit constituting a part of the printing device;

a swing member supported in the main body to be swingable on a second support shaft upward from a standard position; and a biasing member configured to bias the swing member to the standard position, wherein the swing member includes the upper guide portion, the protective cover includes the lower guide portion and a contact portion that pushes the swing member upward from the standard position when the protective cover pivots in the outward direction from the closed position, the protective cover can pivot from the closed position to an open position, in which the protective cover is away from the protected unit to open an inside of the image forming apparatus, as the contact portion pushes the swing member upward, and the protective cover forms a part of the sheet conveyance path when in the closed position and opens the part of the sheet conveyance path when in the open position.

2. The image forming apparatus according to claim 1, wherein the contact portion is formed on an outer side, along a width direction, of the lower guide portion on the protective cover, the width direction being intersecting with a conveying direction of the sheet, the swing member includes a sliding surface formed on an outer side, along the width direction, of the upper guide portion and on which the contact portion slides when the protective cover pivots in the outward direction from the closed position, and the protective cover can pivot from the closed position to the open position without the lower guide portion coming into contact with the upper guide portion.

3. The image forming apparatus according to claim 2, wherein the sliding surface includes an inclined surface inclined obliquely upward toward the outward direction.

4. The image forming apparatus according to claim 1, wherein the printing device includes a transfer portion configured to transfer a toner image onto the sheet conveyed along a main conveyance path and a fixing portion configured to fix the toner image onto the sheet by applying heat and pressure to the toner image on the sheet, and the protected unit is the fixing portion.

5. The image forming apparatus according to claim 4, further comprising:

a pair of discharge rollers configured to rotate in a first rotation direction to discharge the sheet having passed through the fixing portion, wherein the sheet conveyance path formed by the upper guide portion and the lower guide portion is a part of a sub conveyance path through which the sheet conveyed reversely by the pair of discharge rollers rotating in a second rotation direction passes.

6. The image forming apparatus according to claim 5, further comprising:

an outer cover that covers a side of the protective cover facing in the outward direction and that is supported by the main body to be pivotable in the outward direction from a position in which the outer cover covers the protective cover, wherein the protective cover further includes an inner vertical guide portion adjacent to the lower guide portion, the outer cover includes an outer vertical guide portion facing the inner vertical guide portion, and the inner vertical guide portion and the outer vertical guide portion form part of the sub conveyance path.

7. An image forming apparatus comprising:

a main body;

a fixing portion provided inside the main body and configured to fix a toner image formed on a sheet to the sheet;

a sheet conveying portion configured to convey the sheet from the fixing portion to a discharge opening along a main conveyance pat and capable of conveying the sheet reversely at the discharge opening to a reverse conveyance path branching off from the main conveyance path;

a protective cover supported so as to be pivotable between a closed position in which the protective cover covers the fixing unit and an open position in which the protective cover is away from the fixing unit to open an inside of the image forming apparatus, the protective cover forming a part of a lower surface of the reverse conveyance path; and a swing member swingably supported above the protective cover in the main body and forming a part of an upper surface of the reverse conveyance path, wherein the protective cover includes a contact portion moved upward to abut on the swing member when the protective cover pivots from the closed position to the open position, and the swing member swings upward and retracts by being brought into contact with the contact portion.

* * * * *